US008215750B2

(12) United States Patent
Hino

(10) Patent No.: US 8,215,750 B2
(45) Date of Patent: Jul. 10, 2012

(54) METHOD OF MANUFACTURING LIQUID DISCHARGE HEAD

(75) Inventor: Etsuko Hino, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 357 days.

(21) Appl. No.: 12/628,589

(22) Filed: Dec. 1, 2009

(65) Prior Publication Data

US 2010/0149265 A1 Jun. 17, 2010

(30) Foreign Application Priority Data

Dec. 12, 2008 (JP) ..... 2008-316884

(51) Int. Cl.
*B41J 2/14* (2006.01)

(52) U.S. Cl. ..... 347/47

(58) Field of Classification Search ..... 347/47; 216/27

See application file for complete search history.

(56) References Cited

U.S. PATENT DOCUMENTS

| | | | | |
|---|---|---|---|---|
| 5,510,818 | A | 4/1996 | Shimomura et al. | |
| 7,484,829 | B2 * | 2/2009 | Sugahara | 347/45 |
| 7,629,111 | B2 | 12/2009 | Kubota et al. | |
| 7,658,469 | B2 | 2/2010 | Hino et al. | |
| 7,931,356 | B2 * | 4/2011 | Lu et al. | 347/68 |
| 8,033,645 | B2 * | 10/2011 | Van Den Berg et al. | 347/47 |
| 2006/0277755 | A1 | 12/2006 | Kubota et al. | |
| 2007/0085877 | A1 | 4/2007 | Ohkuma et al. | |
| 2008/0018712 | A1 | 1/2008 | Saito et al. | |
| 2009/0284567 | A1 | 11/2009 | Hino et al. | |

* cited by examiner

*Primary Examiner* — Lamson Nguyen

(74) *Attorney, Agent, or Firm* — Fitzpatrick, Cella, Harper & Scinto

(57) ABSTRACT

A liquid discharge head includes a member which is provided with a discharge port for discharging a liquid and made of a resin. Here, the member contains a plurality of inorganic particles. In addition, in a surface of the member on which the discharge port is opened, a density of the particles in a circumference of the discharge port is higher than that of the particles in the vicinity thereof.

4 Claims, 2 Drawing Sheets

METHOD OF MANUFACTURING LIQUID DISCHARGE HEAD

BACKGROUND OF THE INVENTION

1. Field of the Invention

The present invention relates to a liquid discharge head and a method of manufacturing the same.

2. Description of the Related Art

In general, liquid discharge heads applied to an ink jet recording scheme are provided with fine liquid discharge ports, liquid flow paths, and plural energy generating elements which are provided on a portion of the liquid flow paths. Since the liquid flow paths and the liquid discharge ports have a fine structure, there is demand for a technique of manufacturing the structure with high accuracy. As such a technique, from the point of view of accuracy and ease of processing, a photolithography technique is employed.

Recently, in an ink jet recording scheme, in order to improve discharged liquid droplets precisely reaching a recording medium, the distance between the recording head and the recording medium has been significantly shortened. For this reason, the surface of the recording head comes into contact with the recording medium because of surface irregularities such as wrinkles on the recording medium or jamming of the recording medium. In the nozzle having the liquid discharge port formed by the above-mentioned photolithography technique, since the surface of the nozzle in the vicinity of the liquid discharge port is made of a resin material, the surface of the nozzle may be damaged due to contact with the recording medium in some cases. When the damage occurs in the vicinity (nozzle portion) of the liquid discharge port, a discharging direction of the discharging liquid droplet is deviated so as to cause deterioration in printing quality.

As a method of improving strength of the nozzle surface including the liquid discharge ports, there has been generally known a method in that a filler made of an inorganic oxide such as amorphous silica or a resin is added to a resin material so as to adjust a physical property of the resin material. For example, U.S. Pat. No. 5,510,818 discloses a method of manufacturing in an ink jet recording head by a transfer-molding forming method using an epoxy resin which is reduced in linear expansion coefficient by adding an inorganic filler.

As described above, by adding the inorganic fine particles to the resin material, an elastic modulus of the resin material can be increased and the mechanical strength thereof can be increased. However, when the inorganic fine particles are added to the resin material in order to increase the strength of the nozzle surface, the elastic modulus of the resin material is increased by the influence of the inorganic fine particles, and as a result, stress is also increased in some cases. When the stress is increased, there may be a problem in that deformation, cracking, and peeling of the material of the discharge ports occur.

In addition, particularly when a transparent photo-hardening resin is employed, the added inorganic fine particles influence the hardening property, so that it may cause deterioration in patterning property, for example, resolution and contrast, and deterioration in adhesiveness to the material in some cases.

In addition, as described above, the shape of the discharge ports can particularly influence the printing quality, and it is appropriate that the mechanical strength in the vicinity of the discharge ports is high.

SUMMARY OF THE INVENTION

Accordingly, an objective of the present invention is to provide a liquid discharge head which has a function appropriate for a nozzle material, such as the patterning property or the adhesiveness, and in which a mechanical strength of a nozzle surface, in particular, the vicinity of the discharge port, is improved.

The liquid discharge head according to an example of the invention includes a member which is provided with a discharge port for discharging a liquid and made of a resin. Here, the member contains a plurality of inorganic particles. In addition, in a surface of the member on which the discharge port is opened, a density of the particles in a circumference of the discharge port is higher than that of the particles in the vicinity thereof.

According to the invention, an image can be recorded with high quality over a long period, and the liquid discharge head with high reliability can be provided. In addition, the liquid discharge head can be manufactured in a simple manner.

Further features of the present invention will become apparent from the following description of exemplary embodiments with reference to the attached drawings.

DESCRIPTION OF THE EMBODIMENTS

Hereinafter, the exemplary embodiments of the invention will be described with reference to the drawings. Further, in the description, the ink jet recording head is exemplified as an application of the liquid discharge head of the invention, but the scope of the invention is not limited thereto. The invention can be applied also to a liquid discharge head which is used to manufacture bio chips or to print electronic circuits.

Figure 2:
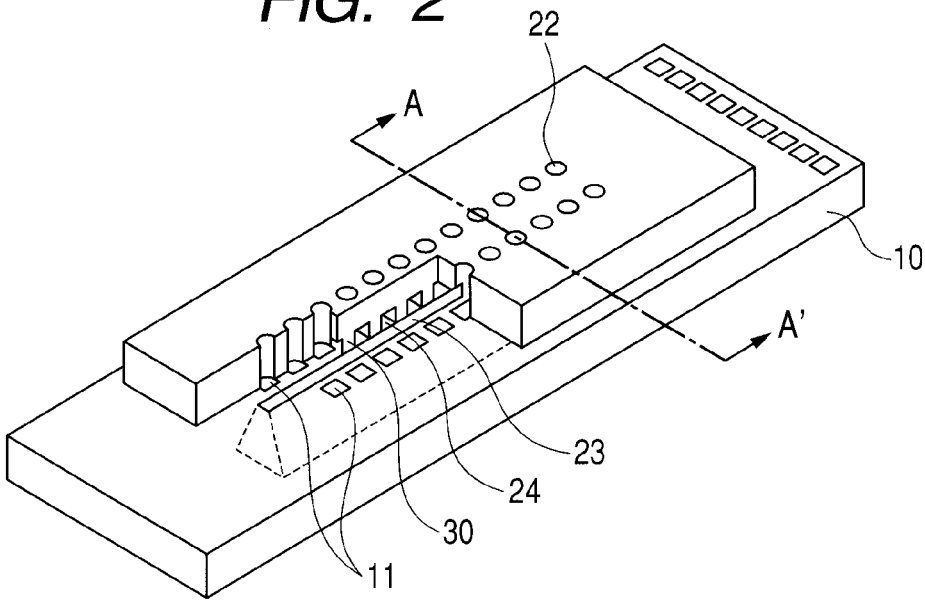
FIG. 2 is a perspective view schematically illustrating an example of an ink jet recording head according to the invention.

FIG. 2 is a perspective view schematically illustrating an example of the liquid discharge head according to the invention. As shown in FIG. 2, a plurality of energy generating elements 11 are provided on a substrate 10 to generate energy for discharging a liquid. On the substrate 10, a discharge port member 30, which is provided with discharge ports 22 corresponding to the energy generating elements 11, is provided. The discharge port member 30 serves also as a liquid flow path member for forming liquid flow paths 24 which are communicated with the discharge ports. In addition, a supply port 23 of the liquid is provided to pass through the substrate 10.

The discharge port member 30 is made of a hardened material of a photo-polymerizable resin composition.

Next, the photo-polymerizable resin composition, which is used to form the discharge member 30 of the invention will be described. The photo-polymerizable resin composition of the invention contains at least components (a) to (c) in the following.

(a) Polymerizable Resin (b) Photo-polymerization Initiator (c) Inorganic Fine Particles (a) Polymerizable Resin Here, as the polymerizable resin (a), there can be used a cationic polymerizable resin, a radical polymerizable resin, or an anionic polymerizable resin. For example, the cationic polymerizable resin means a resin having a vinyl group or a cyclic ether group which is a cationic polymerizable group. In particular, a resin having an epoxy group, an oxetane group, or a vinyl ether group is suitably used.

As a specific example of the epoxy resin, the following resins can be exemplified: a bisphenol type epoxy resin containing monomer or oligomer having bisphenol structure such as bisphenol-A-diglycidylether or bisphenol-F-diglycidylether, a phenol novolac type epoxy resin, a cresol novolac type epoxy resin, a trisphenolmethane type epoxy resin, an epoxy resin having alicyclic epoxy structures such as 3,4-epoxycyclohexenylmethyl-3',4'-epoxycyclohexenecarboxylate. Alternatively, a polyfunctional epoxy resin with a portion having an epoxy group on a side chain of an alicyclic structure, which is expressed in Equation (1) below, is also appropriately used.

(1)

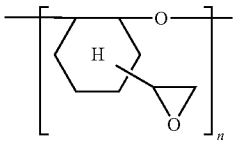

(where n denotes an integer)

In addition, the bisphenol type epoxy resin expressed in Equation (2) below is appropriately used.

(2)

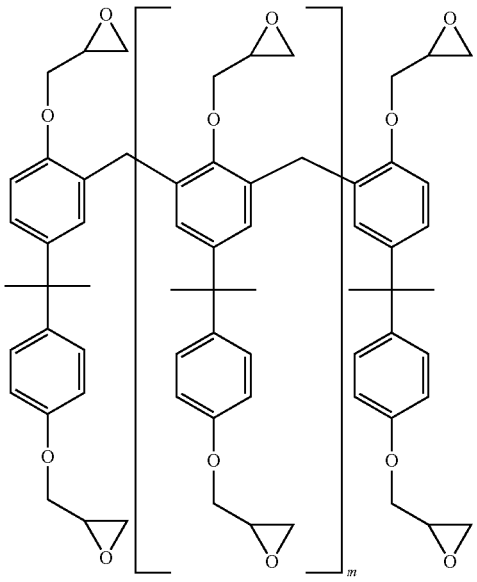

(where m denotes an integer)

In order to obtain good patterning property, it is appropriate for the cationic polymerizable resin to be in a solid state at room temperature or to have a melting point of 40° C. or higher in a stage before polymerization. In addition, a chemical compound is appropriately used of which an epoxy equivalent weight (or oxetane equivalent weight) is equal to or less than 2000, and more preferably, equal to or less than 1000. By using the epoxy resin of which the epoxy equivalent weight is equal to or less than 2000, a crosslink density in hardening reaction, Tg or a heat distortion temperature of a hardened material, the adhesiveness to a substrate, and the ink resistance are easily increased.

On the other hand, in the method of manufacturing the liquid discharge head according to the invention, there is used a phenomenon in which the monomeric epoxy compound move from an unhardened portion to the hardened portion according to difference in chemical potential, therefore, the inorganic fine particles move from a hardened portion to an unhardened portion. For this reason, in addition to the cationic polymerizable resin as described above, a cationic polymerizable compound of low molecules is suitably added in order to give flowability at a temperature (bake temperature) in the polymerization reaction. As the cationic polymerizable compound of low molecules as described above, for example, a monofunctional or a difunctional epoxy compound, a vinyl compound, an oxetane compound which are used as an epoxy dilution agent are exemplified.

As a specific example of the cationic polymerizable compound of low molecules, 3,4-epoxycyclohexenylmethyl-3',4'-epoxycyclohexenecarboxylate (Registered Trademark "CEL2021P" made by Daicel Chemical Industries. Ltd.), vinylcyclohexene monoxide, 1,2:8,9 Diepoxylimonen, or their analog can be exemplified.

In addition, as the cationic polymerizable resin containing an oxetane group, a resin containing a phenol novolac type oxetane compound or a cresol novolac type oxetane compound can be exemplified. Further, a resin containing a trisphenolmethane type oxetane compound, a bisphenol type oxetane compound, or biphenol type oxetane compound can also be exemplified similarly. When the resins containing these oxetane groups are used together with the epoxy resin, the hardening reaction is appropriately accelerated in some cases.

(b) Photo-Polymerization Initiator

As the photo-polymerizable initiator, an initiator can be selected which corresponds to the polymerization type of polymerizable resin (a). When the cationic polymerizable resin is used as polymerizable resin (a), a photo-cationic polymerization initiator can be used as the polymerization initiator (b). As the photo-cationic polymerization initiator, onium salt such as sulfonium salt and iodonium salt, borate salt, a compound having an imide structure, a compound having a triazine structure, and a compound having a structure which is selected from azo compounds or peroxides can be exemplified. As a photo-cationic polymerization initiator which is put on the market, "SP-150", "SP-170", and "SP-172" (Registered Trademark) made by ADEKA Co., Ltd., or "Rhodorsil 2074" (Registered Trademark) made by Rhodia Co., Ltd. may be used. In particular, from the point of view of sensitivity, stability, and reactivity, aromatic sulfonium salt and iodonium salt are appropriately used. In addition, in order to improve the sensitivity or to adjust a photosensitive wavelength, various photo sensitizers can also be used. The additive amount of the photo-cationic polymerization initiator is not particularly limited, but an optimal amount thereof may be appropriately added according to a known method of preparing the light curable resin composition. For example, 0.5 to 10 parts by mass of the photo-cationic polymerization initiator is appropriately added to 100 parts by mass of the cationic polymerizable resin.

(c) Inorganic Fine Particles

As the inorganic fine particles (c), a metal single body, inorganic oxide, inorganic carbonate salt, inorganic sulfate salt, phosphoric acid salt, carbon, and pigment can be exemplified. As the metal single body, gold, silver, platinum, aluminum can be exemplified. In addition, as the inorganic oxide, silica (colloidal silica, aerosil, crushed glass, etc.), alumina, titania, zirconia, zinc oxide, barium titanate, zirconium titanate, lead titanate, lithium niobate, copper oxide, lead oxide, yttrium oxide, tin oxide, and magnesium oxide can be exemplified. In addition, as the inorganic carbonate salt, calcium carbonate and magnesium carbonate can be exemplified. As the inorganic sulfate salt, barium sulfate and calcium sulfate can be exemplified. As the phosphoric acid salt, calcium phosphate and magnesium phosphate can be exemplified.

The shape of the above-mentioned inorganic fine particles is not limited to a spherical shape, but the inorganic fine particles may be in an ellipsoid shape, a flat shape, a rod shape, or a fiber shape. The average primary particle diameter of the fine particles is smaller than an exposure wavelength, and is suitably selected such that the exposure wavelength is less absorbed. In addition, the average particle diameter is suitable to be equal to or less than 50 nm. As commercially available specific particles that satisfy these conditions, the following can be exemplified.

"Methanol Silica Sol" (Registered Trademark) which is silica sol made by Nissan Chemical Industries, Ltd., "IPA-ST"(Registered Trademark), "IPA-ST-UP" (Registered Trademark), "EG-ST" (Registered Trademark), "NPC-ST-30" (Registered Trademark), "DMAC-ST" (Registered Trademark), "MEK-ST" (Registered Trademark), "MIBK-ST" (Registered Trademark), "XBA-ST" (Registered Trademark), "PMA-ST" (Registered Trademark), "PL-1" (Registered Trademark) which is silica sol made by Fuso Chemical Co., Ltd., "PL-2" (Registered Trademark), "PL-3" (Registered Trademark), "OSCAL SERIES" (Registered Trademark) which is silica sol made by Shokubai Kagaku Kogyo Co., Ltd., "Alumi Sol 10" (Registered Trademark) which is alumina sol made by Kawaken Fine Chemicals Co., Ltd., and "Alumi Sol 10D" (Registered Trademark).

These inorganic fine particles may be used alone, or two or more kinds of these may be mixed and used.

The contained amount of the inorganic fine particles in the photosensitive resin composition is appropriately equal to or more than 5% by weight and equal to or less than 60% by weight in solid content conversion with respect to the total sum of the above-mentioned components of (a) to (c). This is because when the contained amount of the inorganic fine particles is equal to or more than 5 mass %, a desired performance can be effectively exhibited, and when the contained amount of the inorganic fine particles is equal to or less than 60% by weight, the patterning property of the resin composition can be favorable. More favorably, the contained amount of the inorganic fine particles is equal to or more than 10 mass % and equal to or less than 40% by weight.

The inorganic fine particles may be subjected to a physical surface treatment such as a plasma discharge treatment or a corona discharge treatment for the purpose of improving the dispersion stability in a dispersion liquid or a coating liquid, or enhancing the affinity of the cationic polymerizable resin (a) or a solvent. In addition, for the same purpose, a chemical surface treatment may be carried out with various surface active agents or hydrolysable silane compounds. In particular, as a surface preparation agent for carrying out the chemical surface treatment, the hydrolysable silane compounds and/or the hydrolyzate-partial condensate thereof (siloxane compound) may be used together. As the hydrolysable silane compound, the compounds shown in Equation (3) below may be exemplified.

$$(R_4)_r\text{—Si—}(OR_2)_s \quad (3)$$

Here, r+s=4, (r=0, 1, 2 or 3, s=1, 2, 3, or 4), $R_2$ represents a saturated or unsaturated hydrocarbon residue, and $R_4$ represents a substituted or non-substituted alkyl group or aryl group. Specifically, the following compounds can be exemplified, but the invention is not limited to the following compounds.

Tetramethoxysilane, tetraethoxysilane, tetrapropoxysilane, methyltrimethoxysilane, methyltriethoxysilane, methyltripropoxysilane, ethyltrimethoxysilane, ethyltriethoxysilane, ethyltripropoxysilane, propyltrimethoxysilane, propyltriethoxysilane, propyltripropoxysilane, phenyltrimethoxysilane, phenyltriethoxysilane, phenyltripropoxysilane, diphenyldimethoxysilane, diphenyldiethoxysilane, glycidoxypropyltrimethoxysilane, glycidoxypropyltriethoxysilane, glycidoxypropylmethyldimethoxysilane, glycidoxypropylmethyldiethoxysilane, glycidoxypropyldimethylmethoxysilane, glycidoxypropyldimethylethoxysilane, 2-(epoxycyclohexyl)ethyltrimethoxysilane, 2-(epoxycyclohexyl)ethyltriethoxysilane.

These hydrolysable silane compounds may be used alone, or two or more kinds of these may be mixed and used.

In addition, when the hydrolysable silane compound is used, after the inorganic fine particles (c) and the hydrolysable silane compound are mixed in a solvent and the inorganic fine particles are uniformly dispersed, the cationic polymerizable resin (a) and the photo-cationic polymerization initiator (b) are appropriately mixed.

Further, when the inorganic fine particles (c) and the hydrolysable silane compound are mixed, the silane compound may be hydrolyzed/condensed and then mixed with the inorganic fine particles. Alternatively, after the silane compound and the inorganic fine particles are mixed with each other, the hydrolysis/condensation may be carried out. In general, the hydrolysis/condensation reaction is carried out under the presence of water and a solvent. Acid, alkali and a catalytic agent such as a metal complex may be used together as needed.

The above-mentioned light curable resin composition may be combined with other additive agents as needed. For example, a silane coupling agent for the purpose of enhancing adhesiveness to a substrate, a hardening accelerator, and a conditioning agent for development (patterning property) can be exemplified.

Hereinafter, the invention will be described in more detail by exemplary embodiments.

PREPARATION EXAMPLE 1

Preparation of Inorganic Fine Particles Solution 1

The inorganic fine particle solution 1 containing the hydrolysable silane compound was prepared according to the following sequence. Using dilute hydrochloric acid as a catalyst, hexyl triethoxysilane of 19.87 g (0.08 mol), phenyltriethoxysilane of 24.04 g (0.1 mol), glycidoxypropyltriethoxysilane of 5.57 g (0.02 mol), colloidal silica ("PL-1" of 13% by weight of solid content, which is a registered trademark made by Fuso Chemical Co., Ltd.,) of 34.2 g, and water of 10.8 g were stirred at room temperature, and then subjected to heating under reflux for hours so as to obtain the inorganic fine particle solution 1 (hydrolysable silane condensation product solution).

PREPARATION EXAMPLE 2

Preparation of Inorganic Fine Particles Solution 2

The inorganic fine particle solution 2 containing the hydrolysable silane compound was prepared according to the following sequence. Using dilute hydrochloricacid as a catalyst, hexyl triethoxysilane of 19.87 g (0.08 mol), phenyltriethoxysilane of 24.04 g (0.1 mol), glycidoxypropyltriethoxysilane of 5.57 g (0.02 mol), colloidal silica ("PL-1" of 13% by weight of solid content, which is a registered trademark made by Fuso Chemical Co., Ltd.,) of 131.9 g, and water of 10.8 g were stirred at room temperature, and then subjected to heating under reflux for 24 hours so as to obtain the inorganic fine particle solution 2 (hydrolysable silane condensation product solution).

PREPARATION EXAMPLE 3

The hydrolysable silane condensation product solution was prepared in a composition in which the inorganic fine particles (colloidal silica) were removed from Preparation Example 1.

(Hardened Layers 1 to 3)

After the solvent was properly removed from the resin composition prepared as shown in Table 1 so as to have a proper density of solid content, layers of the light curable resin composition having a negative photosensitivity were formed on a silicon substrate by spin coating and prebaked at 90° C. for 4 minutes. Further, after prebaking, the film thickness was 20 μm.

Next, using a mask aligner "MPA 600 super" (Registered Trademark) which is made by Canon Inc., the entire surface of the light curable resin composition was exposed. Finally, in order to harden completely the light curable resin composition, the heating treatment was implemented at 200° C. for 1 hour.

(Comparative Hardened Layer 1)

The resin composition described in Table 1 was prepared, and the hardened film was manufactured similarly to the hardened layer 1.

TABLE 1

| | Light curable resin composition | Hardened Layer 1 | Hardened Layer 2 | Hardened Layer 3 | Comparative Hardened Layer 1 |
|---|---|---|---|---|---|
| (a) | Inorganic Fine Particle Solution in Preparation Example 1 | 78.4 | — | — | — |
| | Inorganic Fine Particle Solution in Preparation Example 2 | — | 176 | 176 | — |
| | Inorganic Fine Particle Solution in Preparation Example 3 | — | — | — | 44.2 |
| (b) | Epoxy Compound 1 | 20 | 20 | 20 | 20 |
| | Epoxy Compound 2 | — | — | 5 | — |
| (c) | Photo-cationic Polymerization Initiator 1 | 2 | 2 | 2 | 2 |
| | Cationic polymerization accelerator | 0.2 | 0.2 | 0.2 | 0.2 |

Note) numerical values in the Table show parts by mass. In addition, the cationic polymerizable resin (b), the photo-cationic polymerization initiator, and the cationic polymerization accelerator (c) were prepared as in the following.

Epoxy Compound 1: "EHPE-3150" (Registered Trademark) which is made by Daicel Chemical Industries. Ltd.

Epoxy Compound 2: "CEL2021P" (Registered Trademark) which is made by Daicel Chemical Industries. Ltd.

Photo-cationic Polymerization Initiator 1: "SP-172" (Registered Trademark) which is made by ADEKA Co., Ltd.

Cationic Polymerization Accelerator: trifluoro copper methanesulfonate (II)

It is very difficult to measure the hardness/elastic modulus of the fine region in the edge of the pattern in the invention. Then, the elastic modulus of the above-mentioned hardened film of the hardened layers 1 to 3 and the comparative hardened layer 1 were measured. The elastic modulus was measured using the Fisher Scope H-100 made by Fisher Instrument Co., Ltd. The results are shown in Table 2.

TABLE 2

| | Additive Amount of Inorganic Fine Particle (% by weight) | Elastic Modulus (GPa) |
|---|---|---|
| Hardened Layer 1 | 10 | 4.5 |
| Hardened Layer 2 | 30 | 6.1 |
| Hardened Layer 3 | 27.6 | 5.6 |
| Comparative Hardened Layer 1 | 0 | 3.6 |

(The additive amount of the inorganic fine particles in Table 2 means a ratio of solid content (in the coated film).)

From the results, it is supposed that when a density gradient is generated in the inorganic fine particles, the elastic modulus increases according to the density and the mechanical strength is enhanced.

EXAMPLE 1

The ink jet recording head was manufactured using the light curable resin composition used in the hardened layer 1. FIGS. 3A to 3H show a process illustrating a method of manufacturing the ink jet recording head.

First, the silicon substrate 10 on which electricity-heat transducing elements were formed as the ink discharging energy generating elements 11 was coated with poly(methylisopropenylketone) as a dissoluble resin by spin coating so as to form a film. Next, after prebaking at 120° C. for 6 minutes, the pattern of the ink passage was exposed by a mask aligner "UX 3000" (Registered Trademark) made by Ushio Inc. The exposure was carried out for 3 minutes, and the development was carried out using methylisobutylketone/xylene=2/1, and the rinse was carried out using xylene. The poly methylisopropenylketone is a so-called positive resist which can be dissolved with respect to an organic solvent by UV irradiation, so that the pattern formed by the resin is formed in an unexposed portion so as to form an ink passage pattern (liquid flow path pattern) 12 (see FIG. 3A). Further, after the development, the film thickness of the ink passage pattern 12 was 20 μm.

Next, the light curable resin composition of the hardened layer 1 was coated on the ink passage pattern 12, which was formed by the dissoluble resin, by spin coating and then prebaked at 90° C. for 4 minutes. The coating and the prebaking were carried out 3 times, and a covering resin layer 13 with a film thickness of 55 μm was formed on the ink passage pattern 12 (see FIG. 3B).

Figure 3A:
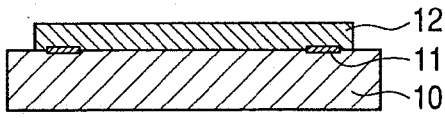
FIGS. 3A, 3B, 3C, 3D, 3E, 3F, 3G and 3H are cross-sectional views schematically illustrating an example of a method of manufacturing an ink jet recording head according to the invention.
Figure 3B:
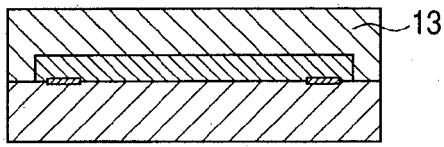
Figure 3C:
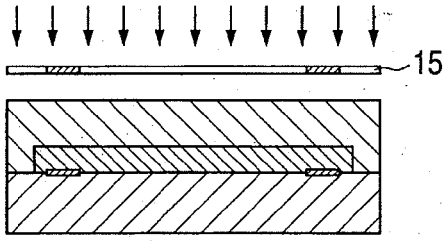

Next, with the mask aligner "MPA 600 super" (Registered Trademark) made by Canon Inc., a first discharge port pattern was exposed using the mask 15 and heated at 90° C. for 4 minutes (see FIG. 3C).

Figure 1A:
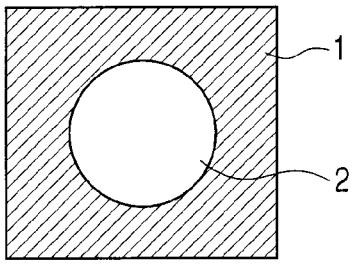
FIGS. 1A, 1B and 1C are schematic views illustrating a state of an ink jet recording head according to the invention in a manufacturing process.
Figure 1B:
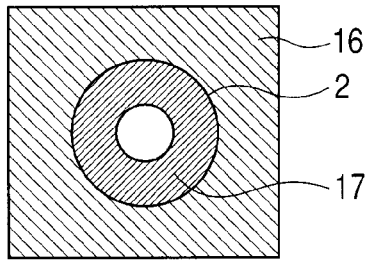
Figure 1C:
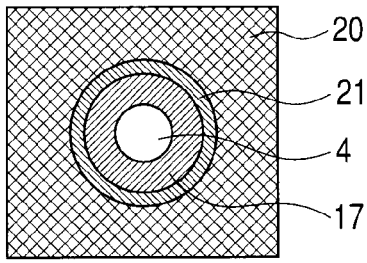

Here, FIGS. 1A to 1C are top views illustrating the vicinity of the discharge port of the liquid discharge head of the invention. As shown in FIG. 1A, the first discharge port pattern is exposed (a first exposure) with respect to the layer of the light curable resin composition. At this time, the mask for the first discharge port pattern was prepared to be larger than a desired size of the discharge port, and then the hardening reaction of the light curable resin composition was accelerated. Then, the hardening reaction proceeded, and an exposed region 1 became a hardened portion 16 (see FIG. 1B). In the exposed region 1, the monomer components in the light curable resin composition were consumed so as to form the difference in chemical potential between the exposed portion 1 and the unexposed portion 2. The monomers began to move from the unexposed region 2 to the exposed region 1, and on the other hand, the inorganic fine particles began to move from the exposed region 1 to the unexposed region 2. As a result, as shown in FIG. 1B, the density of the inorganic fine particles in the edge region 17 of the first discharge port pattern became higher than that of the inorganic fine particle in the hardened portion 16.

Figure 3D:
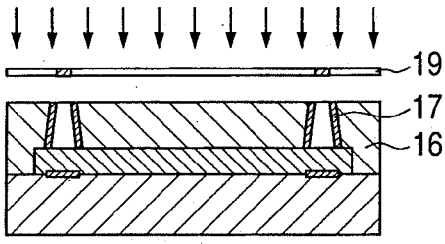

Next, using the mask 19 fitted to a desired size of the discharge port, the second discharge port pattern was exposed and heated at 90° C. for 4 minutes. At this time, the edge region 17 formed in the previous process, in which the density of the inorganic fine particles was high, was exposed (see FIG. 3D). In FIG. 3D, reference numeral 16 denotes a portion irradiated by the first exposure, and reference numeral 17 denotes a region in which the density of the inorganic fine particles was increased.

Here, the discharge port shapes of the first discharge port pattern and the second discharge port pattern are in a similar shape relationship. The center point may be in the same position.

The difference between the diameters of the first discharge port pattern and the second discharge port pattern may be appropriately equal to or less than 5 μm, and may be more appropriately equal to or less than 2 μm This is because when the difference in width of the regions which are exposed only in the second exposure is too large, the discharge port may be formed in the region of which the density is not higher than that in the further inner side of the edge region 17 in which the density of the inorganic fine particles is high.

Figure 3E:
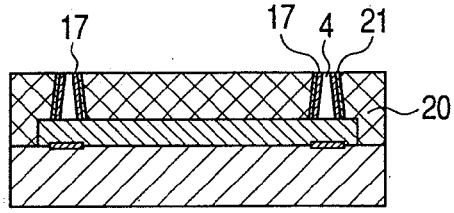

FIGS. 3E and 1C are conceptual views illustrating a state after the second exposure. In the drawings, reference numeral 20 denotes a portion which is exposed by the first and second exposures and hardened, and reference numeral 21 denotes a portion which is exposed by the second exposure and hardened. The density of the inorganic fine particles in these portions 21 is higher than that of the outside (the portion indicated by reference numeral 20) thereof. The unexposed portion 4 and 17 in FIG. 1C are portions which are not exposed when the covered resin layer 13 is implemented by both of the first exposure and the second exposure.

Figure 3F:
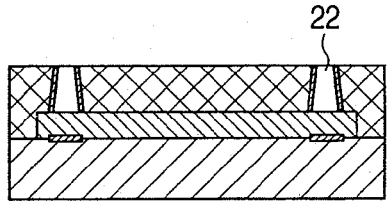

Thereafter, the development was carried out with methylisobutylketone, and the rinse was carried out with isopropyl alcohol, so that the discharge port 22 was formed (see FIG. 3F).

Here, the discharge port size of the mask 15 used in the first exposure was larger than the discharge port diameter of the mask 19 used in the second exposure by 1 μm. Therefore, the discharge port pattern is obtained of which the mechanical strength in the vicinity of the discharge port is high, and which has a sharp pattern edge shape.

Figure 3G:
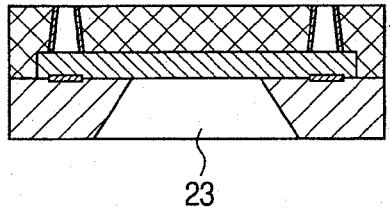
Figure 3H:
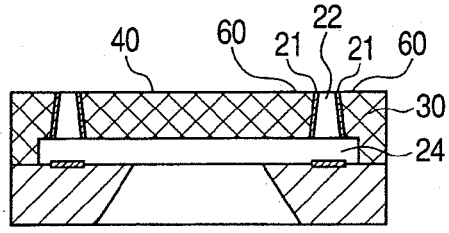

Next, the mask is properly disposed in order to form an ink supply port on the rear surface of the substrate, and the silicon substrate is subjected to anisotropic etching so as to form the ink supply port (see FIG. 3G). During the anisotropic etching of the silicon substrate, the surface of the substrate in which the nozzle is formed is protected by a rubber protective film (not shown).

After the anisotropic etching was completed, the rubber protective film was removed. Further, the entire surface was subjected to UV irradiation using the "UX 3000" again. And the dissoluble resin layer formed with the ink passage pattern 12 was dissolved. Next, while being applied with ultrasonic waves, the substrate was immersed into methyl lactate for 1 hour, and then the ink passage pattern 12 was dissolved and removed so as to form the ink passage 24. Thereafter, in order to harden completely the covered resin layer and the liquid-repellent layer, the substrate was subjected to heating treatment at 200° C. for 1 hour so as to obtain a discharge port member 30 (see FIG. 3H).

Finally, the ink supply member is bonded to the ink passage port so as to complete the ink jet recording head.

As shown in FIGS. 3A to 3H, the ink jet recording head obtained by the manufacturing method of the invention is provided with the discharge port 22 which discharges the liquid and has the discharge port member 30 which is formed of the hardened resin, and the discharge port member 30 includes the inorganic particles. In the surface 40 in which the discharge port 22 of the discharge port member 30 is opened, the density of the particles of the portion 21 of the circumference of the discharge port 22 is higher than the density of the particles in the portion 60 of the vicinity of the portion 21 of the circumference of the discharge port 22 of the discharge port member 30.

COMPARATIVE EXAMPLE 1

Using the resin composition used in the comparative hardened layer 1, the ink jet recording head was manufactured similarly to Example 1.

(Evaluation)

The following evaluations were carried out on the ink jet recording heads obtained in Example 1 and Comparative Example 1 in order to evaluate characteristics regarding reliability.

<Printing Quality Evaluation>

The ink jet recording heads obtained in Example 1 and Comparative Example 1 were filled with the black ink "BCI-9Bk" (Registered Trademark) made by Canon Inc., and then the printings were carried out. The images obtained by both the heads had high quality.

<Adhesiveness Evaluation>

The ink jet recording heads obtained in Example 1 and Comparative Example 1 were immersed in the ink "BCI-6C" (Registered Trademark) (of which pH is about 9) made by Canon Inc., and the pressure cooker test (PCT) was carried out (at 121° C. for 100 hours). As a result of observing the adhesiveness status of the nozzle constituents, there was no change therein.

<Durability Evaluation (Paper Jam Test)>

An evaluation pattern was printed on a paper wrinkled by folding in a strip shape, and the printing was stopped part way through, and then the paper was pulled out, and all this was carried out 10 times.

Thereafter, as a result of printing the evaluation pattern for the printing quality, there were generated uneven lines by the head of Comparative Example 1, and on the other hand, by the head of Example 1, a good image was obtained.

From the above-mentioned results, it can be seen that the ink jet recording head according to the invention has high strength in the vicinity of the discharge port of the discharge port member, and that durability is enhanced. It can be considered that this is because the density of the inorganic particles in the vicinity of the discharge port of the discharge port member is higher than the density of the inorganic particles further outside of the vicinity of the discharge port of the discharge port member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-316884, filed Dec. 12, 2008, which is hereby incorporated by reference herein in its entirety.

What is claimed is:

1. A liquid discharge head comprising:

a member which is provided with a discharge port for discharging a liquid and made of a resin, wherein the member contains a plurality of inorganic particles, and wherein in a surface of the member through which the discharge port is opened, a density of the particles in a circumference of the discharge port is higher than that of the particles in the vicinity thereof.

2. The liquid discharge head according to claim 1, wherein an average particle diameter of the particles is equal to or less than 50 μm.

3. The liquid discharge head according to claim 1, wherein the member contains a hardened material of an epoxy resin.

4. The liquid discharge head according to claim 1, wherein the member contains a hardened material of a siloxane compound and an epoxy resin.

* * * * *